US006189738B1

(12) United States Patent
Rosenthal

(10) Patent No.: US 6,189,738 B1
(45) Date of Patent: Feb. 20, 2001

(54) MULTICHAMBER DISPENSER

(75) Inventor: Karl-Heinz Rosenthal, Reichshof/Oberagger (DE)

(73) Assignee: Innocos Innovative Verpackungen fur die Kosmetische Industrie GmbH (DE)

( * ) Notice: Under 35 U.S.C. 154(b), the term of this patent shall be extended for 0 days.

(21) Appl. No.: 09/308,998

(22) PCT Filed: Oct. 23, 1997

(86) PCT No.: PCT/DE97/02491

§ 371 Date: Jun. 1, 1999

§ 102(e) Date: Jun. 1, 1999

(87) PCT Pub. No.: WO98/24706

PCT Pub. Date: Jun. 11, 1998

(30) Foreign Application Priority Data

Dec. 6, 1996 (DE) ..... 196 50 556

(51) Int. Cl.[7] ..... B67D 5/06

(52) U.S. Cl. ..... 222/144.5; 222/482; 222/556

(58) Field of Search ..... 222/94, 129, 144.5, 222/183, 212, 482, 534, 536, 556

(56) References Cited

U.S. PATENT DOCUMENTS

| | | | | |
|---|---|---|---|---|
| 1,698,404 | * | 1/1929 | Hopkins | 222/129 |
| 2,218,092 | * | 10/1940 | Nitardy | 221/60 |
| 5,765,725 | * | 6/1998 | Matt | 222/129 |
| 5,794,819 | * | 8/1998 | Smith | 222/129 |
| 5,873,494 | * | 2/1999 | Dallas | 222/129 |

* cited by examiner

*Primary Examiner*—Joseph A. Kaufman
*Assistant Examiner*—Melvin A. Cartagena
(74) *Attorney, Agent, or Firm*—Diller, Ramik & Wight, PC

(57) ABSTRACT

Disclosed is a dispenser for flowable agents, comprising a main body (1) to which at least two stores can be secured for receiving said agents. The main body (1) has a first channel (16) and at least one second channel for releasing said agents out of the stores and is fitted with a first closing device (21) which can be actuated to sealingly close at least one of the channels. In order to enable said agents to be released out of the various stores, it is suggested that the main body (1) be provided with at least one additional closing device (22) desgined to selaingly close at least the second channel, independantly of the others.

19 Claims, 6 Drawing Sheets

Fig. 1
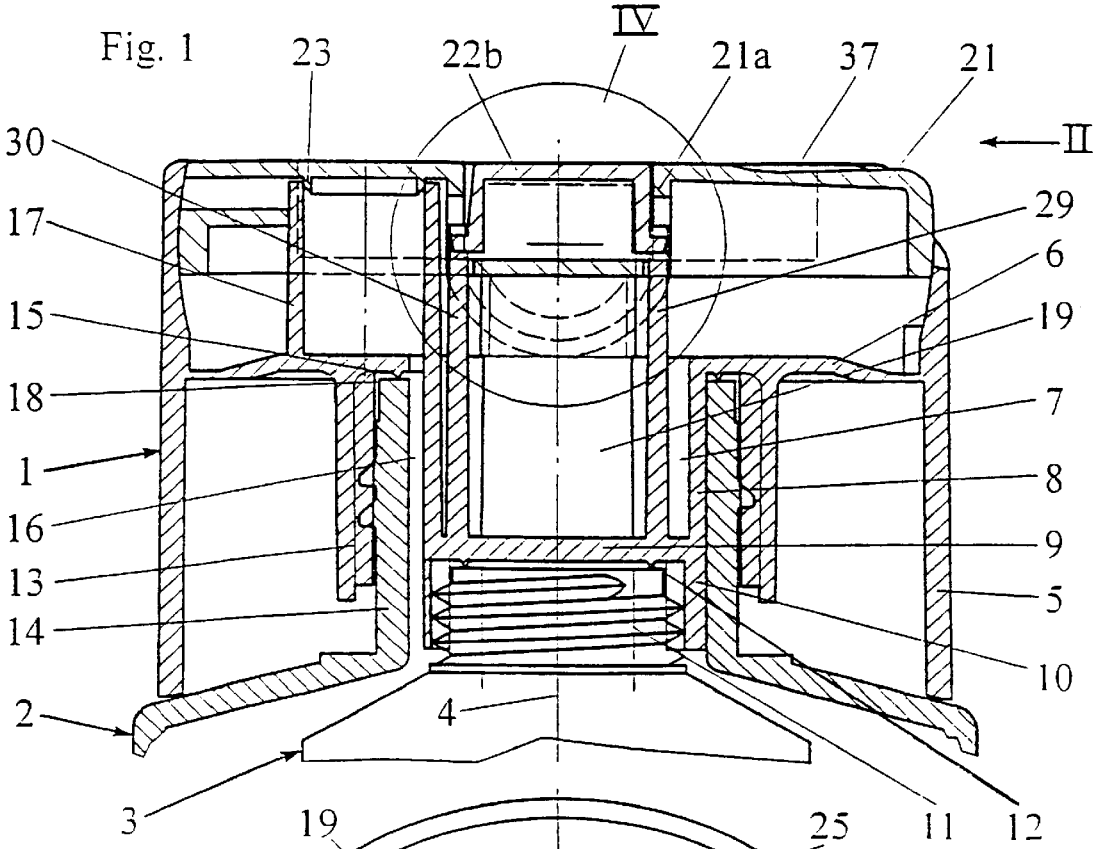
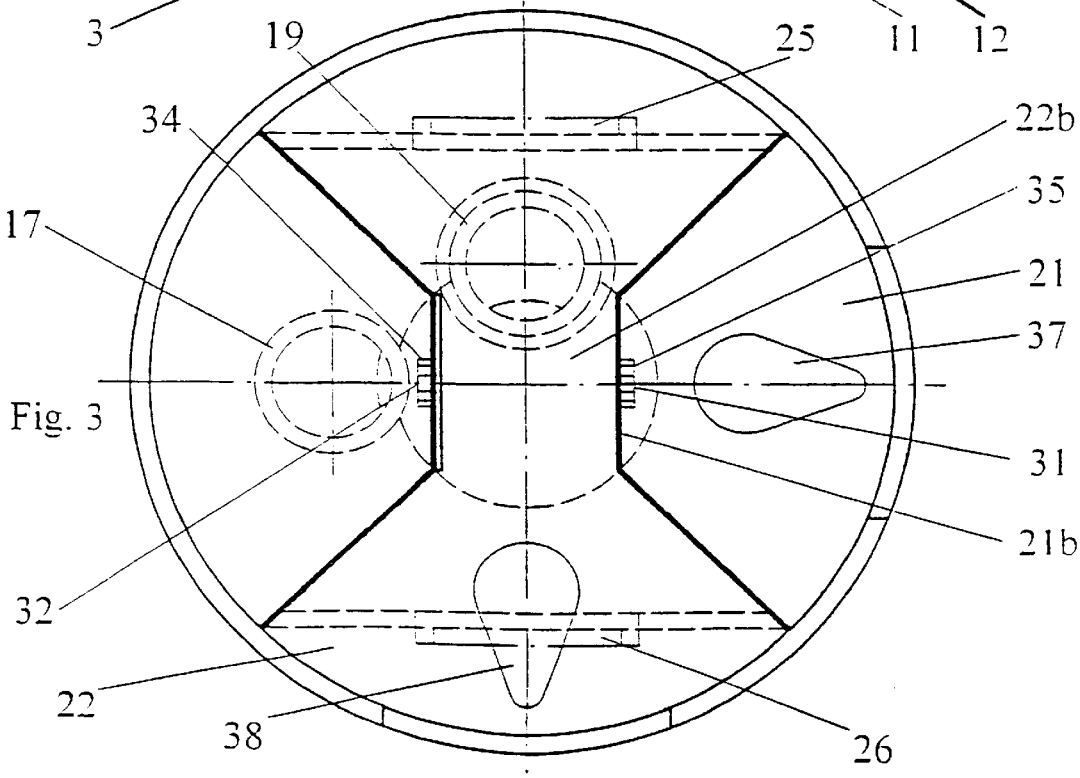
Fig. 3

Fig. 2
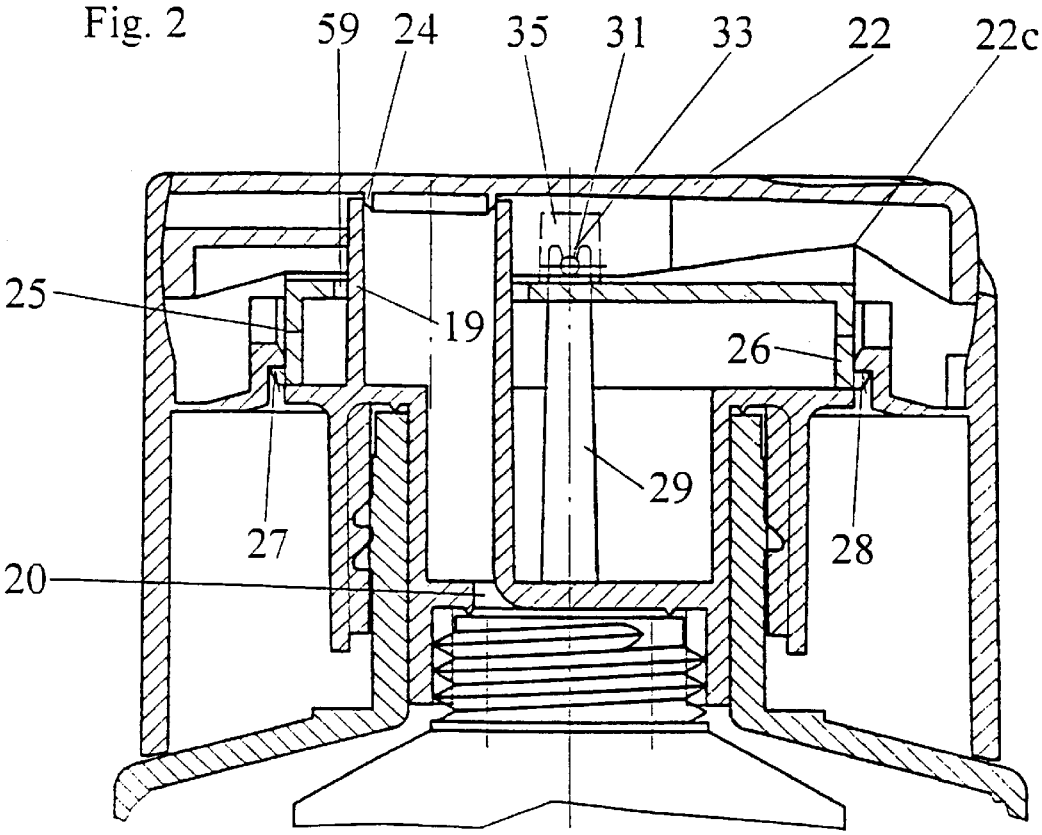
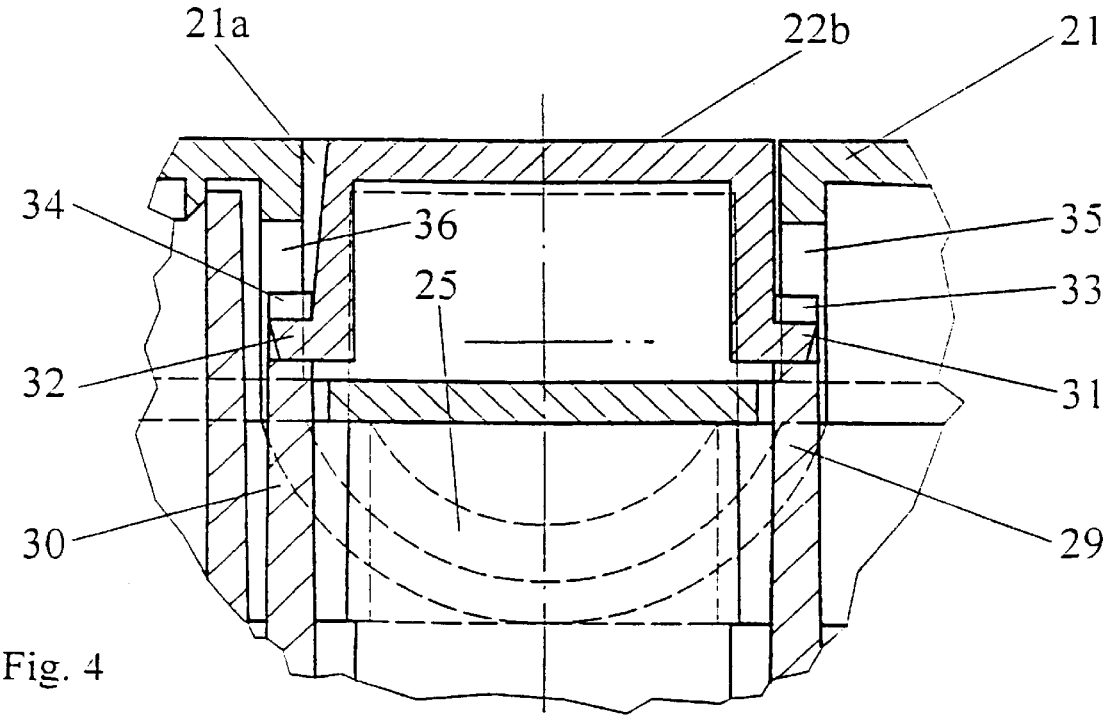
Fig. 4

MULTICHAMBER DISPENSER

BACKGROUND OF THE INVENTION

The invention concerns a dispenser for flowable media with a main body, to which at least two stores can be attached to accommodate said media, where the main body has a first channel and at least one second channel to permit separate dispensing of the media from the stores, and is equipped with a first, manipulable closing device with which at least one of the channels can be sealed tight.

A dispenser of this kind, preferably made of injection-moulded plastic, is available on the market as a so-called "double tube" and is manufactured by Messrs. Yoschida, Japan. This dispenser has two concentric stores designed as tubes, the inner tube being positioned inside the outer tube. The outer tube has a substantially larger diameter than the inner tube. The two tubes contain different flowable media, which are hereinafter referred to as "products". Each of the tubes has its own outlet port, with which it can be attached to the separate channels of the main body, which are designed as product ports. The main body has a cover plate, with which the product ports can be jointly sealed. The channels can be sealed by a cap.

Although this dispenser enables two different products to be stored in a very small space, it is only possible to dispense both products from the dispenser simultaneously. Separate dispensing of the two products is impossible. Furthermore, the dispenser requires special bottles with specially designed bottlenecks. As the bottlenecks are positioned next to one another, they must be of particularly narrow design. In order to keep the dispenser down to a reasonable size, the bottles must also be designed in such a way that they can be positioned very close to one another. Special bottles of this kind are relatively expensive.

Consequently, the object of the present invention is to further develop a generic dispenser in such a way that each product can be dispensed separately from the other products without resulting in mixing of the products.

SUMMARY OF THE INVENTION

According to the invention, the object is solved in that the main body has at least one additional closing device, with which one of the channels can be sealed tight, independently of the other channels.

Based on the configuration of the dispenser according to the invention, two or more products can be stored completely separately in a small space and dispensed individually, without contaminating one another during dispensing. For example, a daytime and night-time face cream, foundation and makeup remover or a shampoo and matching conditioner, can be stored together but dispensed separately.

A dispenser with a first and second channel for dispensing two different media preferably has a first closing device, where the first closing device is designed as a cover plate which can be connected to the main body in rotating fashion, and a second closing device. The second closing device likewise has a cover plate which can be connected to the main body or the first cover plate in rotating fashion.

In a particularly advantageous configuration of the dispenser according to the invention, the second channel is positioned at roughly 90 degrees to the first channel, and the axes of rotation of the cover plates are offset in the same way as the channels.

In a dispenser according to the invention, in which a first and second connector are provided on the main body, to which the stores can be separately attached, the stores and the connectors are positioned concentrically and the first connector has a smaller diameter than the second connector, so that one of the stores is positioned inside the other. In this context, there is a space between the connectors, through which one of the media can flow out of the store.

In a preferred configuration, the stores are tubes. The filling of the tubes is considerably simplified by the design according to the invention. The open ends of the tubes which have not yet been welded, are screwed into the connectors, filled with the different products and then welded together in a common welding step. The inner and outer tubes then have a common welded seam. The connectors of the main body can be adapted to the diameters of the outlet ports of the tubes as required. Standard tubes can be used, meaning that the special tubes required by the prior art can be dispensed with. This simplifies manufacturing, reduces inventory costs and simultaneously offers greater flexibility in the manufacturing of different dispensers.

In a preferred configuration of the dispenser according to the invention, at least one of the cover plates has U-shaped guide elements, which engage guide grooves provided on the main body. The guide elements are mounted in the guide grooves in rotating fashion and guide the cover plate. This design ensures particularly stable mounting of the cover plate. Alternatively, mounting pins can be provided on the cover plate—preferably integrally moulded—which engage corresponding holes provided in the main body which serve to accommodate the mounting pins. The respective design of the mounting method for the cover plates depends on the nature of the application.

It is also possible for at least one of the cover plates to have mounting pins which can be connected in rotating fashion to supports provided on the main body or the other cover plate. Of course, all the cover plates can also be mounted on supports of this kind in rotating fashion, so that the arrangement described previously, comprising guide elements and guide grooves, can be dispensed with.

In a dispenser according to the invention, which is preferably designed for the use of stores designed as bottles, the bottles can be mounted parallel to one another on the main body using corresponding connectors.

In order to ensure the unequivocal assignment of the products to the respective cover plates, the cover plates can be designed in different colours. In this way, the danger of switching the products is substantially reduced. Numerous other options for assignment would also be conceivable in this context.

An example of the invention is illustrated in the drawing and described in detail based on the figures. The figures show the following:

BRIEF DESCRIPTION OF THE DRAWINGS

FIG. 1 A cross-sectional side view of a first configuration of the dispenser, FIG. 2 A cross-sectional front view of the dispenser in FIG. 1 in the direction of Arrow II, FIG. 3 A top view of the dispenser in FIG. 1, FIG. 4 An enlarged view of Section IV in FIG. 1, FIG. 5 The dispenser in FIG. 1 in the open position, FIG. 6 The dispenser in FIG. 2 in the open position, FIG. 7 A top view of an alternative design of the cover plates, FIG. 8 A side view of an alternative configuration of the dispenser according to the invention, which is used for bottles mounted parallel and adjacent to one another on the dispenser, FIG. 9 A top view of the dispenser in FIG. 8, FIG. 10 A side view of the dispenser in FIG. 9 along Line X—X, FIG. 11 An enlarged perspective view of a guide element and guide groove provided on the cover plates and the main body, FIG. 12 A front view—partially cut away—of the guide element and the guide groove in FIG. 11, and FIG. 13 A side view—partially cut away—of the guide element and the guide groove in FIG. 11.

DESCRIPTION OF THE PREFERRED EMBODIMENTS

Figure 5:
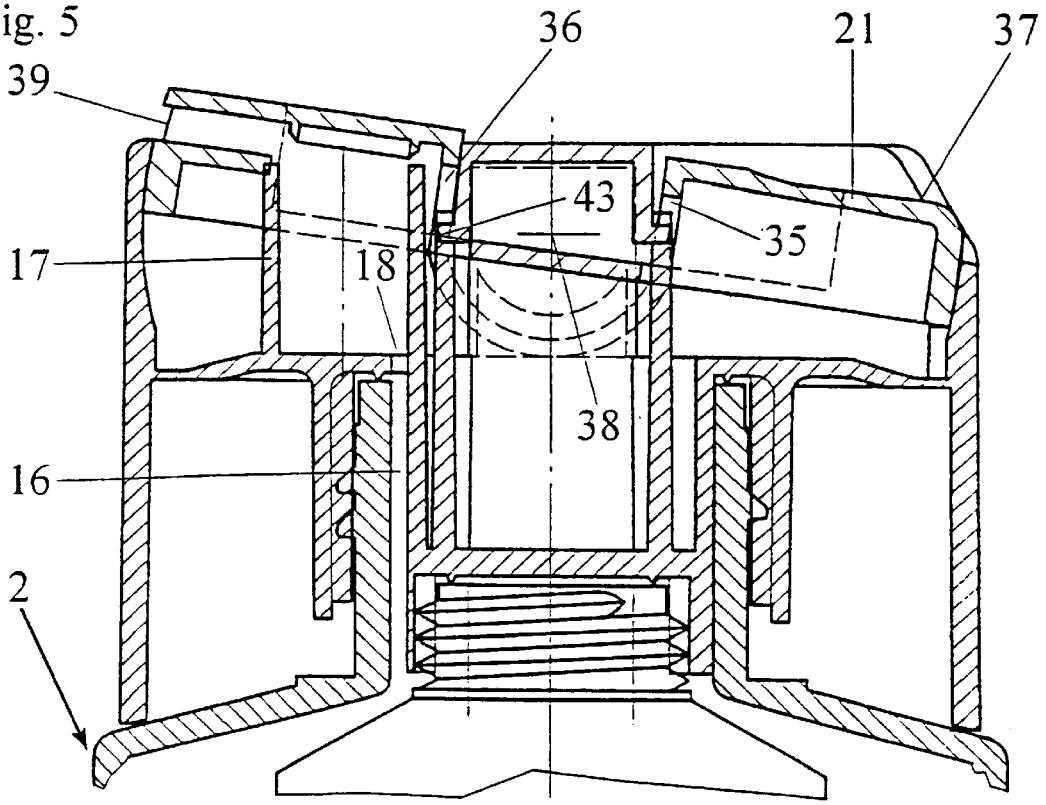

According to the drawing, the dispenser in a configuration designed for tubes, consists of a main body 1 and two stores 2 and 3 designed as tubes, which are mounted on the bottom of the main body. Outer tube 2 contains a first product and inner tube 3 contains a second product. All parts of the dispenser are preferably made of injection-moulded plastic.

In the description, the terms "upwards" and "downwards" are based on the illustration of the dispenser in the figures. In the description of the main body, the term "downwards" refers to the direction facing towards the tubes, "upwards" refers to the direction facing away from the tubes, "outwards" refers to the direction facing away from centre axis 4 of the dispenser and "inwards" refers to the direction facing towards centre axis 4.

FIGS. 1 to 7 show a dispenser in which the stores are designed as concentric double tubes 2 and 3.

Main body 1 consists of an outer wall 5 essentially in the shape of a hollow cylinder, the inside of which has an integrally moulded base plate 6 roughly in the middle which extends radially inwards. Base plate 6 has an essentially cylindrical recess 7 roughly in the centre and extending downwards, which has an essentially vertical wall 8 and a base wall 9 running essentially parallel to base plate 6.

A first connector 10 is integrally moulded on the bottom of base wall 9. The inside of this first connector 10 has a female thread into which a first tube neck 11 is screwed, the tube neck 11 having a male thread corresponding to the female thread of first connector 10. Inner tube 3 is mounted such that base wall 9 is in tight contact with the rim of first tube neck 11. In order to increase the effect of the seal, a ring seal 12 is integrally moulded on the bottom of base wall 9.

A second connector 13 is integrally moulded on the bottom of base plate 6 such that it is concentric to first tube neck 11. Second connector 13 has a larger diameter than first tube neck 11. Outer tube 2 is also connected to main body 1 via a female thread which is integrally moulded on the inside of second connector 13 and engaged by a second tube neck 14 provided on outer tube 2 and having a male thread corresponding to the female thread. In order to increase the effect of the seal in this case, a ring seal 15 is again integrally moulded on the bottom of base plate 6.

At least one region of recess 7 is designed in such a way that a channel 16 is formed between the outside of vertical wall 8 and the inside of second tube neck 14.

A cylindrical first product port 17 is integrally moulded on the top of base plate 6. First product port 17 has a base plate hole 18 on its bottom end bordered by base plate 6. After flowing through channel 16, the product contained in outer tube 2 can flow through this base plate hole 18 into first product port 17.

As is shown particularly clearly in FIG. 2, main body 1 also has a second, likewise cylindrical, product port 19, which is integrally moulded on the top of base plate 6 and base wall 9. Second product port 19 is positioned roughly at right angles to first product port 17. Base wall 9 has a base wall hole 20 inside second product port 19, through which the product contained in inner tube 3 can pass out of the tube opening and into second product port 19.

The dispenser is closed by two cover plates 21 and 22 mounted on main body 1 in rotating fashion. First cover plate 21 is designed in such a way that it tightly seals first product port 17, whereas second cover plate 22 is designed in such a way that it tightly seals second product port 19. For this purpose, the bottom of first cover plate 21 has an integrally moulded sealing lip 23, whose outside diameter is slightly smaller than the inside diameter of first product port 17 in the region bordering on first cover plate 21. In the closed position, sealing lip 23 tightly engages first product port 17. Second cover plate 22 is designed with a similar sealing lip 24, which tightly engages second product port 19 in the closed position.

As is shown particularly clearly in FIG. 3, cover plates 21 and 22 are offset by 90 degrees in rotating fashion on main body 1. Together, cover plates 21 and 22 form the geometrical shape of a circle. First cover plate 21 has a recess 21*a* roughly in the middle, which is designed to accommodate second cover plate 22. Thus, second cover plate 22 is inserted in first cover plate 21 such that they are flush on top. The geometrical design of cover plates 21 and 22 is variable. In the top view shown in FIG. 3, the conical design of cover plates 21 and 22, which taper to narrow sections 21*b* and 22*b* towards the centre, represents an advantageous configuration. The shape of the two cover plates 21 and 22 need not result in a circle, but rather can also form other shapes, such as a rectangle or triangle.

Both cover plates 21 and 22 are mounted in rotating fashion. For this purpose, first cover plate 21 has two U-shaped, semi-circular guide elements 25 and 26, which engage two guide grooves 27 and 28 integrally moulded on main body 1. Guide elements 25 and 26 are guided in sliding fashion in guide grooves 27 and 28.

Second cover plate 22 is mounted in rotating fashion on two supports 29 and 30 integrally moulded on the top of base wall 9 by way of two pins 31 and 32 integrally moulded on second cover plate 22. Pins 31 and 32 snap into corresponding recesses 33 and 34 on the upper ends of supports 29 and 30 and are thus mounted in rotating fashion therein.

The first cover plate has two openings 35 and 36, which enable supports 29 and 30, when assembled, to pass through first cover plate 21, in order to accommodate pins 31 and 32. Second cover plate 22 also has a hole 59, through which second product port 19 passes.

FIG. 4 shows a cross-sectional enlargement of the mounting of pins 31 and 32 of second cover plate 22 in supports 29 and 30 of main body 1. In the configuration illustrated here, second cover plate 22 is mounted in supports 29 and 30, which are integrally moulded on base wall 9. However, it is also possible to integrally mould supports 29 and 30, or other similar mounting elements, directly on first cover plate 21. Second cover plate 22 is then directly mounted in rotating fashion in first cover plate 21. This simplifies the design and recesses 33 and 34 need not be provided.

FIG. 5 shows the dispenser when first cover plate 21 is depressed. By exerting a force on recess 37 integrally moulded in first cover plate 21, guide elements 25 and 26 are rotated in guide grooves 27 and 28 about their centre point of rotation 38. The side of first cover plate 21 on which the force is exerted is lowered, while the side of the cover plate opposite point of rotation 38 is raised, so that the upper edge of first cover plate 21 rises above the upper edge of outer wall 5 of main body 1. In this position, the first medium can flow out of outer tube 2, through channel 16 and base plate hole 18 into first product port 17, through first outlet aperture 39 of first cover plate 21 and out of the dispenser. During this process, second cover plate 22 remains sealed. Openings 35 and 36 and hole 59 in first cover plate 21 ensure that the motion of first cover plate 21 is not hindered in any way by second cover plate 22.

Figure 6:
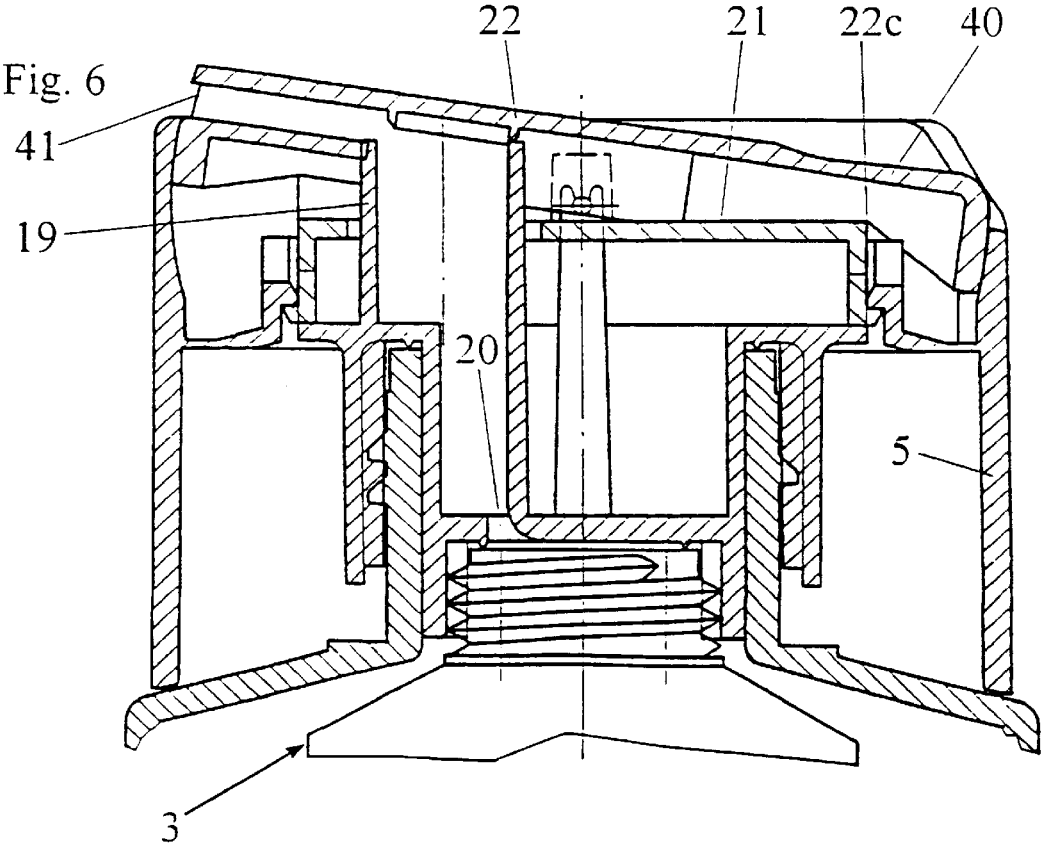

FIG. 6 shows the dispenser when second cover plate 22 is depressed. By exerting a force on recess 40 integrally moulded in second cover plate 22, the second cover plate is rotated about the point of rotation in the axis of pins 31 and 32. The side of second cover plate 22 on which the force is exerted is lowered, while the side of the cover plate opposite the point of rotation is raised, so that the upper edge of second cover plate 22 rises above the upper edge of outer wall 5 of main body 1. In this position, the second medium can flow out of inner tube 3, through base wall hole 20 into second product port 19, through second outlet aperture 41 of second cover plate 22 and out of the dispenser. During this process, first cover plate 21 remains sealed.

Figure 7:
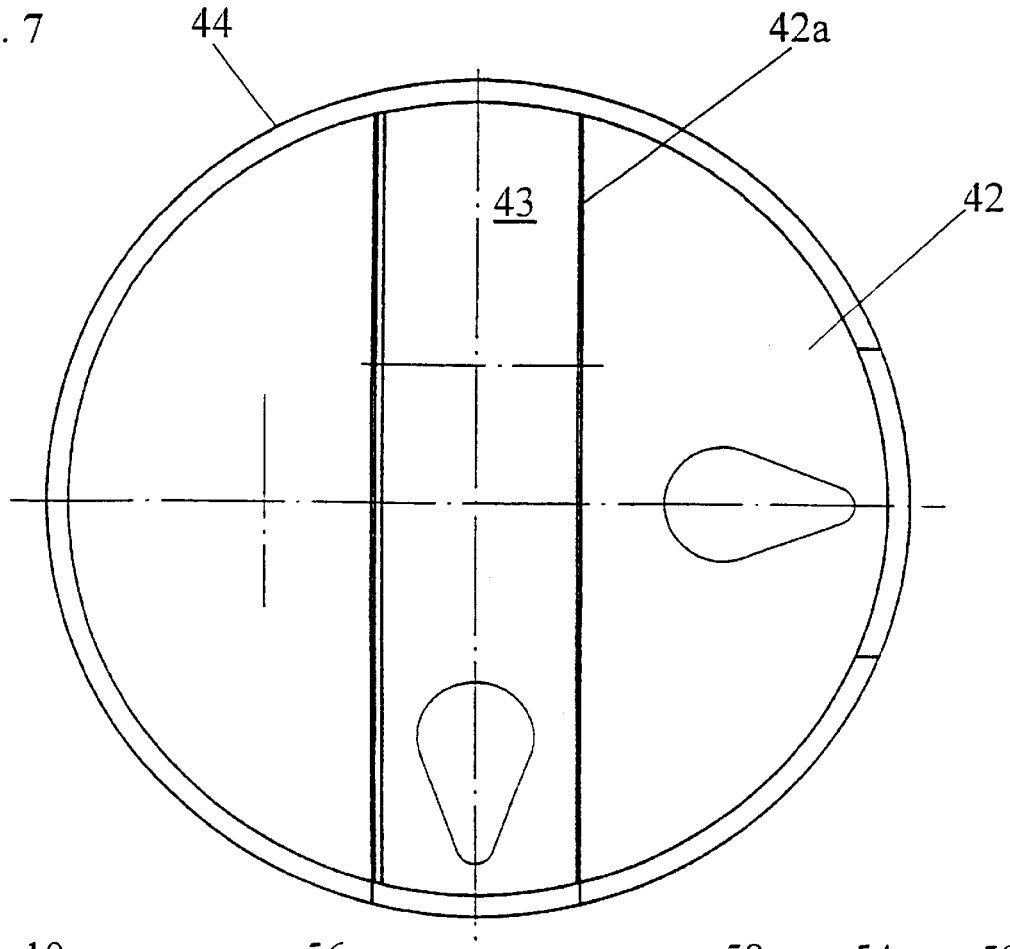

The bottom of second cover plate 22 has a recess 22*c* on the side intended to be pressed down, which makes it possible to lower second cover plate 22 relative to first cover plate 21. During depression, the edge of recess 22*c* comes to rest on first cover plate 21. FIG. 7 shows an alternative geometric design for cover plates 42 and 43. The essentially round first cover plate 42 has a strip-shaped recess 42*a* in the middle which is designed to accommodate second cover plate 43. Strip-shaped second cover plate 43 lies inside it, so that the cover plates are flush on top. The closing of the two product ports and the pivotable mounting of cover plates 42 and 43 on main body 44 are the same as in the configuration shown in FIGS. 1 to 6.

Figure 10:
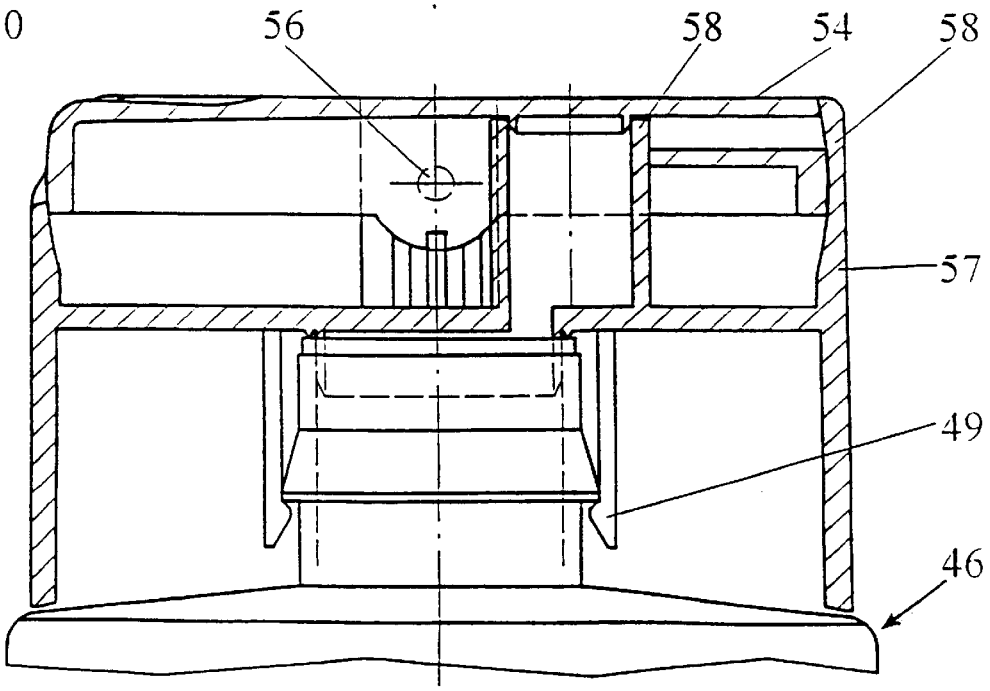
Figure 8:
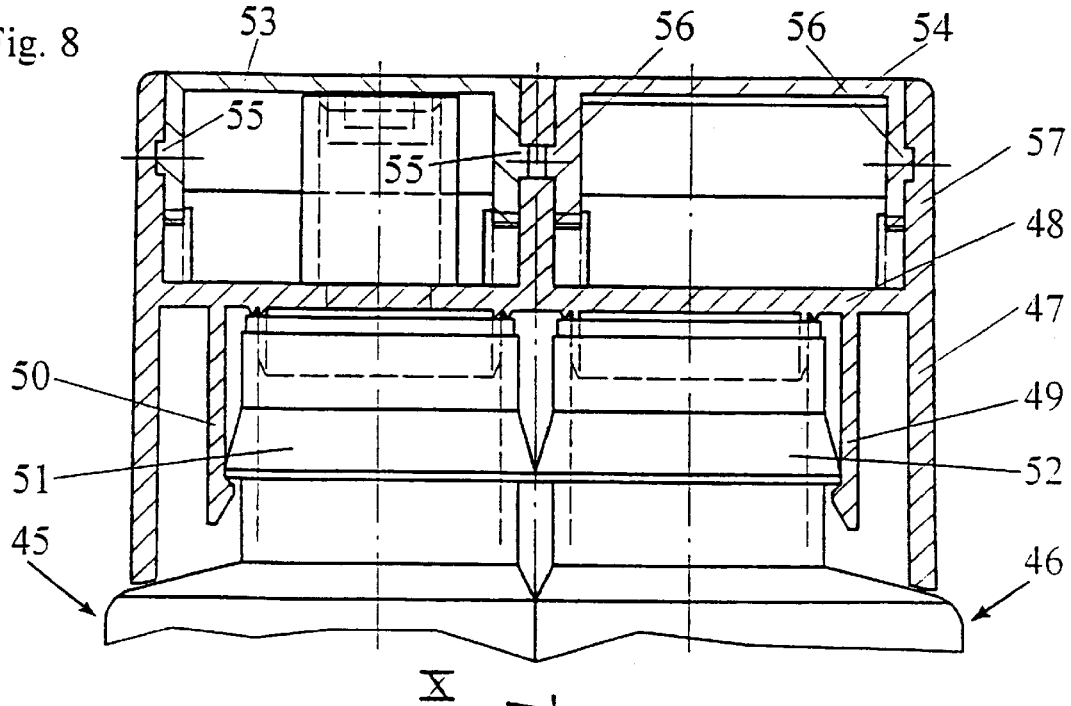
Figure 9:
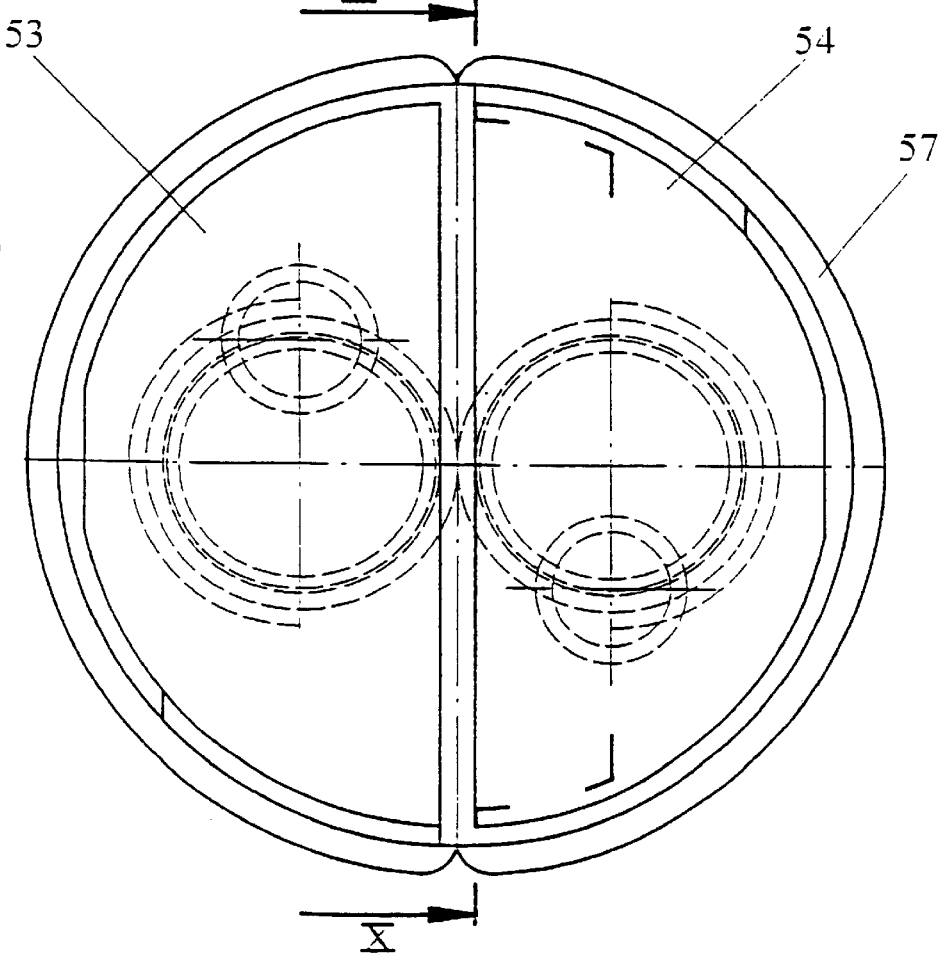

FIGS. 8 to 10 show another configuration of the dispenser according to the invention, which is designed to be used on two parallel, adjacent stores designed as bottles 45 and 46, which are filled with different products.

Main body 47 is connected to bottles 45 and 46 by way of tabs 49 and 50 integrally moulded on the bottom of base plate 48, which snap over corresponding collars 51 and 52 provided on the bottlenecks.

Cover plates 53 and 54—seen in a top view in FIG. 9—are each designed in the shape of a semi-circle and, when assembled, form a full circle. Roughly in the middle of the downward-pointing edges on the side, saucer-shaped (in the cross-section) cover plates 53 and 54 have integrally moulded pins 55 and 56, which engage corresponding recesses provided on main body 57 and, in this way, are mounted in rotating fashion in main body 57.

As is shown particularly clearly in the cross-section in FIG. 10, the product ports (of which only product port 58 is shown in the figure) are offset laterally from the centre axes of bottles 45 and 46, which run through the points of rotation of pins 55 and 56. When pressure is applied to cover plates 53 and 54, the product ports open due to the tilting motion of cover plates 53 and 54, so that the products can then flow through the open outlet apertures (of which only outlet aperture 58 is shown) and out of the dispenser.

Figure 11:
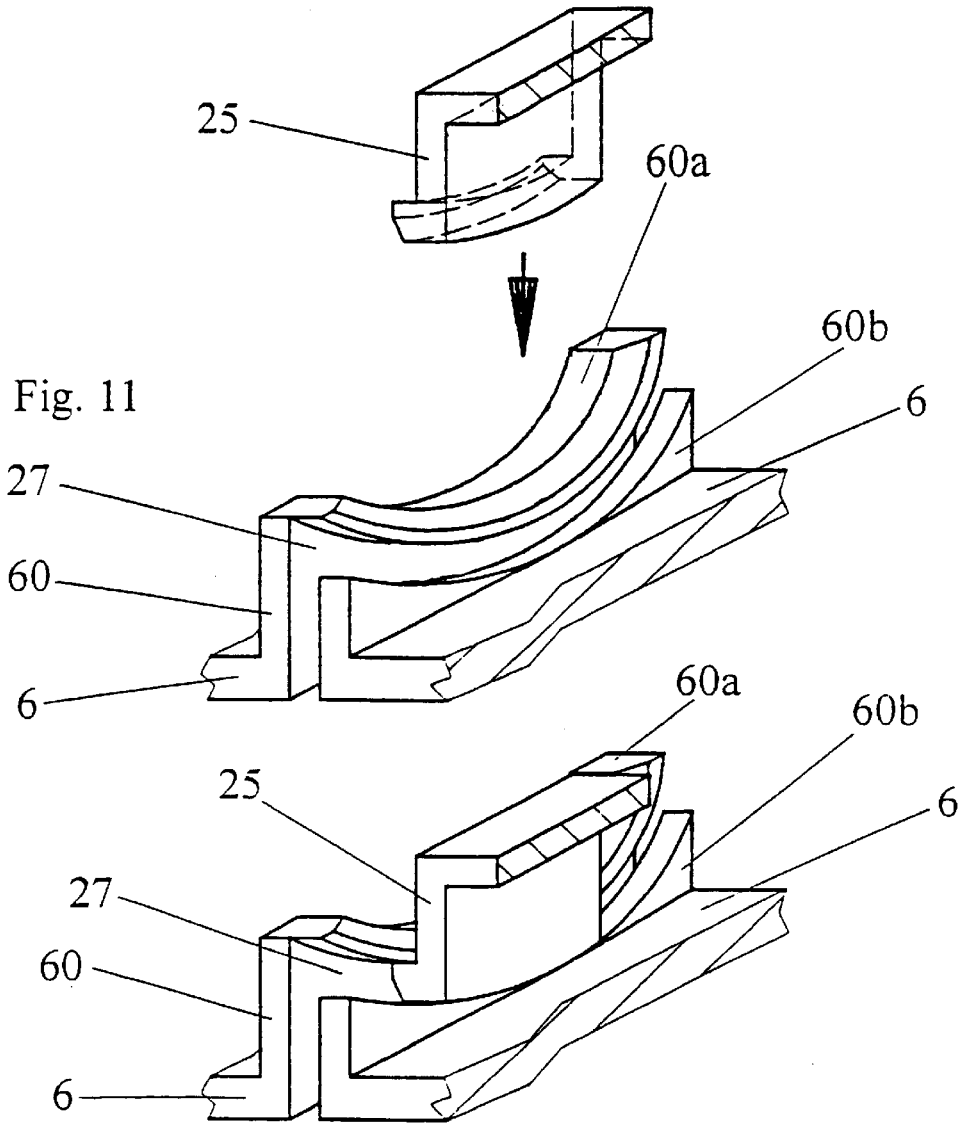
Figure 12:
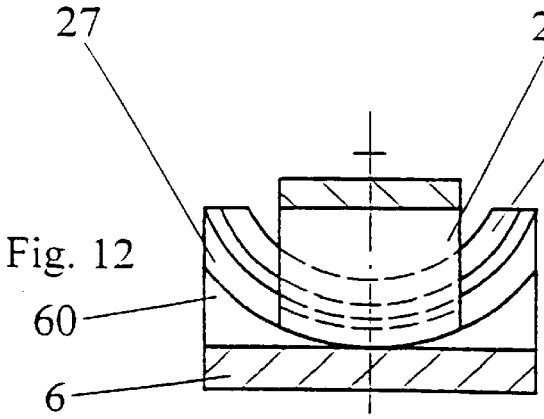
Figure 13:
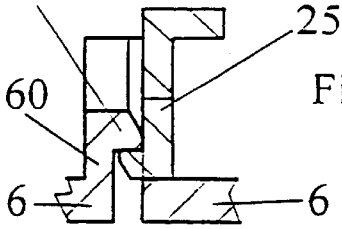

The structural design of guide element 25 and guide groove 27 is illustrated in an enlarged detail view in FIGS. 11 to 13. As can be seen here, curved guide element 25, which is integrally moulded on first cover plate 21, engages corresponding U-shaped guide groove 27. The guide groove runs between a Z-shaped end 60 of base plate 6, where top haunch 60*a* is provided with a concave section, which corresponds to the curve of guide element 25, and an L-shaped end, whose bottom haunch 60*b* has a recess which also corresponds to the curve of guide element 25. Thus, guide groove 27 is formed between haunch 60*a* and haunch 60*b*. Guide element 25 can be snapped into guide groove 27.

In another configuration of the dispenser (not shown in the figures) without supports or guide elements and grooves, the edges of the cover plates are of convex design. These outwardly curved edges rest in corresponding concave recesses provided on the main body or the other cover plates, and are thus mounted in rotating fashion therein.

The configurations described above all referred to dispensers for two different products. The scope of the invention also includes designing dispensers for more than two products. For example, three parallel, adjacent bottles mounted on the main body can be closed by three strip-shaped, adjacent cover plates mounted on the main body in rotating fashion.

Although a preferred embodiment of the invention has been specifically illustrated and described herein, it is to be understood that minor variations may be made in the apparatus without departing from the spirit and scope of the invention, as defined the appended claims.

What is claimed is:

1. A dispenser for flowable media comprising at least first and second stores adapted to accommodate respective first and second flowable media, first and second openings for conducting first and second media from the respective first and second stores, a main body, means for attaching the first and second stores to the main body, said main body including first and second channels for conducting the respective first and second media from said first and second openings to respective first and second dispensing ports of said main body, first and second closures carried by said main body for selectively permitting and preventing dispensing of the respective first and second media from the respective first and second dispensing ports, means for effecting pivotal movement of said first and second closures relative to said main body for pivoting between dispensing and non-dispensing positions, said first and second dispensing ports being offset from each other along an arc of substantially 90°, and said pivotal movement effecting means being disposed substantially normal to each other.

2. The dispenser as defined in claim 1 wherein said pivotal movement effecting means includes first pivot means for effecting pivotal movement of said first closure relative to said main body and second pivot means for effecting pivotal movement of said second closure relative to said main body.

3. The dispenser as defined in claim 2 wherein said pivotal movement effecting means effects pivotal movement of a portion of said second closure substantially within a portion of said first closure.

4. The dispenser as defined in claim 1 wherein said pivotal movement effecting means effects pivotal movement of a portion of said second closure substantially within a portion of said first closure.

5. The dispenser as defined in claim 1 wherein said pivotal movement effecting means includes first pivot means for effecting pivotal movement of said first closure relative to said main body; and said first pivot means include at least one curved guide element of one of said first closure and main body in pivotal relationship to at least one curved guide groove of another of said first closure and main body.

6. The dispenser as defined in claim 5 wherein said pivotal movement effecting means effects pivotal movement of a portion of said second closure substantially within a portion of said first closure.

7. The dispenser as defined in claim 5 wherein said pivotal movement effecting means includes second pivot means for effecting pivotal movement of said second closure relative to said main body; and said second pivot means include at least one pivot pin of one of said second closure and main body in pivotal relationship to at least one pivot bearing surface of another of said second closure and main body.

8. The dispenser as defined in claim 7 wherein said pivotal movement effecting means effects pivotal movement of a portion of said second closure substantially within a portion of said first closure.

9. The dispenser as defined in claim 1 wherein said pivotal movement effecting means includes second pivot means for effecting pivotal movement of said second closure relative to said main body; and said second pivot means include at least one pivot pin of one of said second closure and main body in pivotal relationship to at least one pivot bearing surface of another of said second closure and main body.

10. The dispenser as defined in claim 1 wherein said pivotal movement effecting means effects pivotal movement of a portion of said second closure substantially within a portion of said first closure, and said first closure portion is a recess housing said second closure portion.

11. A dispenser for flowable media comprising at least first and second stores adapted to accommodate respective first and second flowable media, first and second openings for conducting first and second media from the respective first and second stores, a main body, means for attaching the first and second stores to the main body, said main body including first and second channels for conducting the respective first and second media from said first and second openings to respective first and second dispensing ports of said main body, first and second closures carried by said main body for selectively permitting and preventing dispensing of the respective first and second media from the respective first and second dispensing ports, means for effecting pivotal movement of said first and second closures relative to said main body for pivoting between dispensing and non-dispensing positions, and said pivotal movement effecting means are defined by first and second pivot means between said respective first and second closures.

12. The dispenser as defined in claim 11 wherein said first and second pivot means include at least one curved guide element of one of said first and second closures in pivotal relationship to at least one curved guide groove of another of said first and second closures.

13. The dispenser as defined in claim 12 wherein said at least one curved guide groove is formed in a recessed portion of said second closure and said at least one curved guide element is formed in a projecting portion of said first closure housed in said second closure recessed portion.

14. The dispenser as defined in claim 13 including pivot means between said first closure and said main body for effecting relative pivoting movement therebetween.

15. The dispenser as defined in claim 14 wherein said last-mentioned pivot means includes a pair off upstanding posts carried by said main body to which are pivoted pivot pins of said second closures.

16. A dispenser for flowable media comprising at least first and second stores adapted to accommodate respective first and second flowable media, first and second openings for conducting first and second media from the respective first and second stores, a main body, means for attaching the first and second stores to the main body, said main body including first and second channels for conducting the respective first and second media from said first and second openings to respective first and second dispensing ports of said main body, first and second closures carried by said main body for selectively permitting and preventing dispensing of the respective first and second media from the respective first and second dispensing ports, means for effecting pivotal movement of said first and second closures relative to said main body for pivoting between dispensing and non-dispensing positions, and at least one of said first and second channels being located between said first and second stores attaching means.

17. The dispenser as defined in claim 16 wherein said first channel is located between said first and second stores attaching means.

18. A dispenser for flowable media comprising at least first and second side-by-side stores adapted to accommodate respective first and second flowable media, first and second side-by-side openings for conducting first and second media from the respective first and second stores, a main body, means for attaching the first and second stores to the main body, said main body including first and second channels for conducting the respective first and second media from said first and second openings to respective first and second dispensing ports of said main body, first and second closures carried by said main body for selectively permitting and preventing dispensing of the respective first and second media from the respective first and second dispensing ports, means for effecting pivotal movement of said first and second closures relative to said main body for pivoting between open dispensing and closed non-dispensing positions relative to the respective first and second dispensing ports, said pivotal movement effecting means include a downwardly projecting portion of each first and second closure carrying a curved guide element for effecting, and a curved guide groove of said main body receiving therein an associated one of said curved guide elements for effecting said pivoting movement.

19. The dispenser as defined in claim 18 wherein said curved guide grooves and curved guide elements define a common pivoting axis for said first and second closures.

* * * * *